United States Patent [19]

Buckland et al.

[11] Patent Number: 4,758,501

[45] Date of Patent: Jul. 19, 1988

[54] PHOTOGRAPHIC ACETANILIDE COUPLERS AND PHOTOGRAPHIC ELEMENTS CONTAINING THEM

[75] Inventors: Paul R. Buckland, St Albans; Siu C. Tsoi, Watford, both of United Kingdom

[73] Assignee: Eastman Kodak Company, Rochester, N.Y.

[21] Appl. No.: 58,308

[22] Filed: Jun. 5, 1987

[30] Foreign Application Priority Data

Jun. 11, 1986 [GB] United Kingdom ..... 8614213

[51] Int. Cl.[4] ..... G03C 7/36; G03C 7/34

[52] U.S. Cl. ..... 430/389; 430/388; 430/551; 430/552; 430/553; 430/556; 430/557

[58] Field of Search ..... 430/556, 557, 551, 552, 430/553, 389, 388

[56] References Cited

U.S. PATENT DOCUMENTS

| | | | |
|---|---|---|---|
| 3,519,429 | 7/1970 | Lestina | 96/100 |
| 3,891,445 | 6/1975 | Arai et al. | 96/100 |
| 4,228,235 | 10/1980 | Okonogi et al. | 430/542 |
| 4,254,213 | 3/1981 | Masuda et al. | 430/381 |
| 4,513,082 | 4/1985 | Furutachi et al. | 430/552 |
| 4,526,864 | 7/1985 | Takada et al. | 430/551 |
| 4,540,658 | 9/1985 | Sasaki et al. | 430/551 |

FOREIGN PATENT DOCUMENTS

| | | |
|---|---|---|
| 5905246 | 1/1984 | Japan . |
| 5972443 | 8/1984 | Japan . |

OTHER PUBLICATIONS

*Research Disclosure*, Dec. 1978, Item No. 17643, vol. 176, Emsworth Studios, Inc., New York, N.Y.

*Primary Examiner*—Richard L. Schilling
*Attorney, Agent, or Firm*—Richard E. Knapp

[57] ABSTRACT

Novel photographic acetanilide dye-forming couplers comprise a group comprising a stabilizer moiety represented by the formula:

wherein R is halogen or alkoxy having 1 to 4 carbon atoms; $R_1$ is hydrogen, halogen, alkyl or alkoxy; $R_2$ and $R_3$ are individually alkyl; and, X is a linking group. Such couplers provide advantageous stability in dyes formed from the couplers. These couplers are useful in photographic silver halide materials and processes.

11 Claims, No Drawings

PHOTOGRAPHIC ACETANILIDE COUPLERS AND PHOTOGRAPHIC ELEMENTS CONTAINING THEM

This invention relates to novel photographic acetanilide yellow colour couplers and to photographic elements and processes using such couplers.

Alpha-acylacetanilide couplers are used in photographic materials as yellow dye image-formers in photographic colour materials. They are described, for example, in Bailey and Williams, "The Photographic Color Development Process" in the Chemistry of Synthetic Dyes, ed. K. Venkataraman, Academic Press, Inc., New York and London, Volume 4, 341 (1971).

U.S. Pat. No. 4,228,235 describes the use of photographic image dye stabilizers of the formula:

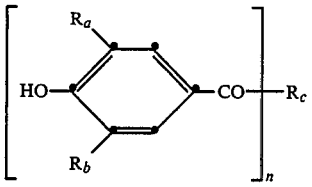

where $R_a$ and $R_b$ individually represent an alkyl group,

Rc represents a n-valent organic group selected from the group consisting of an aliphatic, cycloaliphatic and aromatic group, and n is an integer from 1 to 6.

These compounds are incorporated into sensitive photographic materials and are said to improve the stability of dyes formed from yellow, magenta and cyan color couplers. These compounds are not couplers.

According to the present invention novel acetanilide yellow dye-forming couplers are provided in which a stabilizer moiety is employed particularly as a ballasting group. Not only are the dyes formed from such couplers more stable than dyes from couplers with conventional ballast groups but a smaller weight of coupler and stabilizer is employed compared to a photographic element requiring a separate stabilizer compound, such as in U.S. Pat. No. 4,228,235. Photographic elements of the invention enable thinner layers hence sharper images.

The described advantages are provided by a yellow dye-forming acetanilide photographic coupler having a group comprising a stabilizer moiety represented by the formula:

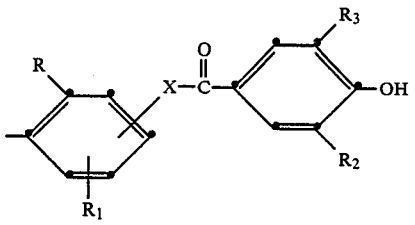

wherein

R is halogen, such as chlorine, bromine and fluorine, or alkoxy having 1 to 4 carbon atoms, such as methoxy, ethoxy, propoxy and butoxy;

$R_1$ is hydrogen or a substituent that does not adversely affect the coupler or dye formed, particularly halogen, such as chlorine, bromine or fluorine, alkyl, for example alkyl containing 1 to 30 carbon atoms, such as methyl, ethyl, propyl, butyl and eicosyl, or alkoxy, such as methoxy, ethoxy, propoxy and butoxy;

$R_2$ and $R_3$ are individually alkyl, such as alkyl containing 1 to 5 carbon atoms, for example, methyl, ethyl, propyl, n-butyl, t-butyl and pentyl; and X is a linking group.

The group comprising the stabilizer moiety is preferably a ballast group that enables the coupler to be non-diffusible in the photographic element.

An illustrative yellow dye-forming acetanilide coupler is represented by the formula:

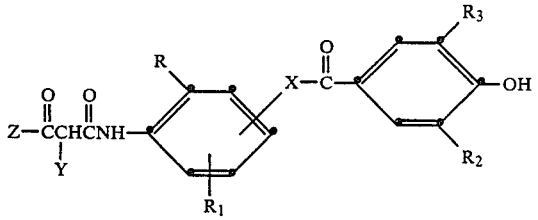

wherein R, $R_1$, $R_2$, $R_3$ and X are as described; Y is hydrogen or a group that splits off on color development, also known as a coupling-off group; and Z is t-butyl or p-alkoxyphenyl. R is preferably chloro or methoxy. $R_2$ and $R_3$ are preferably selected so that the coupler is non-diffusible when present in a photographic material.

The present couplers, together with oxidized color developing agent, form yellow dyes of improved dye stability compared to conventionally ballasted couplers.

Preferably R is chloro or methoxy. $R_1$ may be, for example, hydrogen, methyl, methoxy or chloro. The linking group X may be alkylene, —O—, —alkylene—O—, —COO—alkylene—O—, —O—alkylene—O—, or —NH—. Alkylene, for example, contains 1 to 4 carbon atoms. Y is preferably an aryloxy coupling off group or a group of the formula:

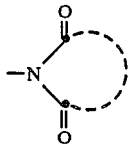

Specific examples of groups which Z may represent include t-butyl, p-methoxyphenyl, and p-n-butoxyphenyl.

The present couplers can be prepared by methods known in the art. For example, they can be prepared by following the scheme:

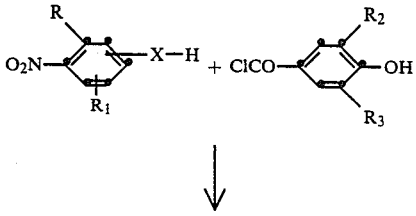

-continued

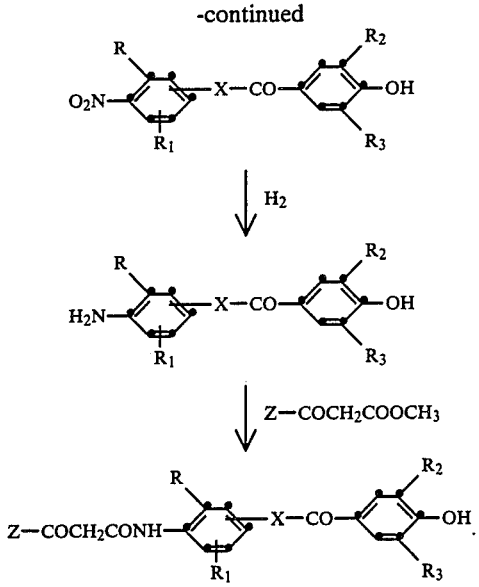

The coupling-off group Y, if present, is then incorporated by known methods.

The dye-forming couplers of this invention can be used in the ways and for the purposes that dye-forming couplers have been previously used in the photographic art. They may be dissolved in processing solutions (unballasted) or incorporated into photographic materials (normally ballasted).

Typically, the couplers are incorporated in silver halide emulsions and the emulsions coated on a support to form a photographic element. Alternatively, the couplers can be incorporated in photographic elements adjacent the silver halide emulsion where, during development, the coupler will be in reactive association with development products such as oxidized colour developing agent. Thus, as used herein, the term "associated therewith" signifies that the coupler is in the silver halide emulsion layer or in an adjacent location where, during processing, it will come into reactive association with silver halide development products.

The photographic elements can be single color elements or multicolor elements. In a multicolor element, the yellow dye-forming couplers of this invention would usually be associated with a blue-sensitive emulsion, although they could be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element would comprise a support bearing a yellow dye image-forming unit comprised of at least one blue-sensitive silver halide emulsion layer having associated therewith at least one yellow dye-forming coupler, at least one of the yellow dye-forming couplers being a coupler of this invention, and magenta and cyan dye image-forming units comprising at least one green- or red-sensitive silver halide emulsion layer having associated therewith at least one magenta or cyan dye-forming coupler respectively. The element can contain additional layers, such as filter layers.

In the following discussion of suitable materials for use in the emulsions and elements of this invention, reference will be made to *Research Disclosure,* December 1978, Item 17643, published by Industrial Opportunities Ltd., The Old Harbourmaster's, 8 North Street, Emsworth, Hants PO10 7DD, U.K. This publication will be identified hereafter as "*Research Disclosure*".

The silver halide emulsion employed in the elements of this invention can be either negative-working or positive-working. Suitable emulsions and their preparation are described in *Research Disclosure* Sections I and II and the publications cited therein. Suitable vehicles for the emulsion layers and other layers of elements of this invention are described in *Research Disclosure* Section IX and the publications cited therein.

In addition to the couplers of this invention, the elements of the invention can include additional couplers as described in *Research Disclosure* Section VII, paragraphs D, E, F and G and the publications cited therein. The couplers of this invention and any additional couplers can be incorporated in the elements and emulsions as described in *Research Disclosures* of Section VII, paragraph C and the publications cited therein.

The photographic elements of this invention or individual layers thereof, can contain brighteners (see *Research Disclosure* Section V), antifoggants and stabilizers (see *Research Disclosure* Section VI), antistain agents and image dye stabilizer (see *Research Disclosure* Section VII, paragraphs I and J), light absorbing and scattering materials (see *Research Disclosure* Section VIII), hardeners (see *Research Disclosure* Section XI), plasticizers and lubricants (see *Research Disclosure* Section XII), antistatic agents (see *Research Disclosure* Section XIII), matting agents (see *Research Disclosure* Section XVI) and development modifiers (see *Research Disclosure* Section XXI).

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethylaniline hydrochloride, 4-amino-3-methyl-N-ethyl-N-β-(methanesulfonamido)ethylaniline sulphate hydrate, 4-amino-3-methyl-N-ethyl-N-β-hydroxyethylaniline sulphate, 4-amino-3-β-(methanesulfonamido)ethyl-N,N-diethylaniline hydrochloride and 4-amino-N-ethyl-N-(2-methoxyethyl)-m-toluidine di-p-toluene sulfonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Specific couplers according to the present invention are listed in Table I and Ia below. (Ph herein means phenyl. Et herein means ethyl.)

TABLE I

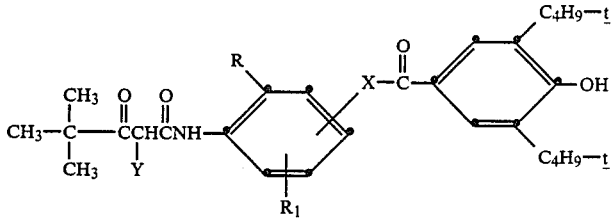

| Coupler | X | Y | R | $R_1$ |
|---|---|---|---|---|
| A1 | 5-$CO_2(CH_2)_2O$— | 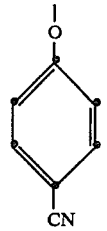 | Cl | H |
| A2 | 5-$CO_2(CH_2)_2O$— | 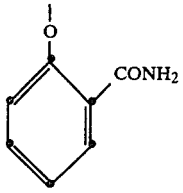 | Cl | H |
| A3 | 5-$CO_2(CH_2)_2O$— | 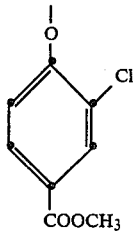 | Cl | H |
| A4 | 5-$CH_2O$— | 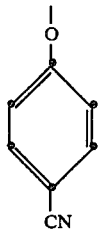 | Cl | H |
| A5 | 4-O— | 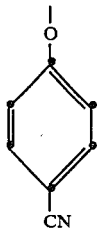 | Cl | H |

TABLE I-continued
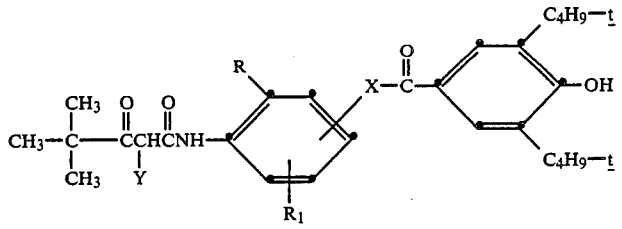
| Coupler | X | Y | R | $R_1$ |
|---|---|---|---|---|
| A6 | 5-$CH_2O$— | 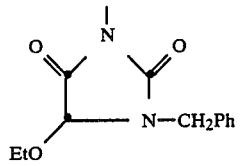 | Cl | H |
| A7 | 5-$CH_2O$— | 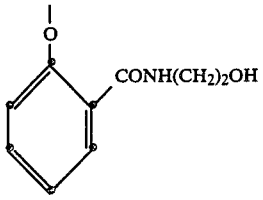 | Cl | H |
| A8 | 5-$CH_2O$— | 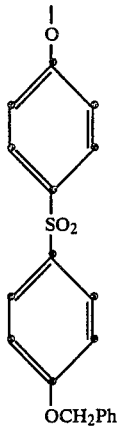 | Cl | H |
| A9 | 4-O— | 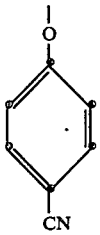 | Cl | 5-Cl |
| A10 | 4-O— | 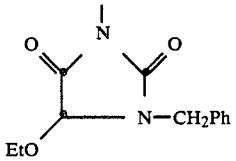 | Cl | 5-Cl |

TABLE I-continued
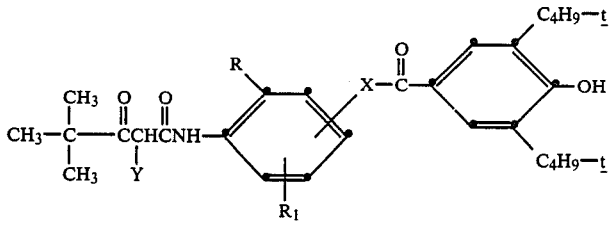
| Coupler | X | Y | R | $R_1$ |
|---|---|---|---|---|
| A11 | 4-O— | 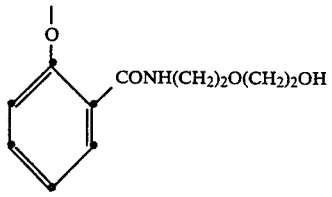 | Cl | 5-Cl |
| A12 | 5-O | 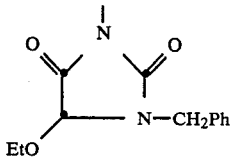 | Cl | H |
| A13 | 5-O | 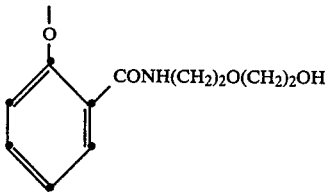 | Cl | H |
| A14 | 5-NH— | 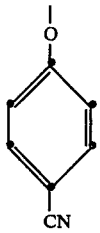 | Cl | H |
| A15 | 5-NH— | 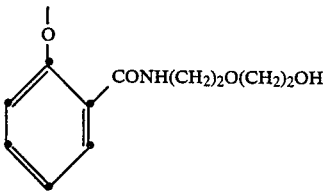 | Cl | H |
| A16 | 5-NH— | 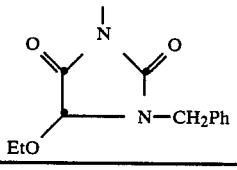 | Cl | H |

TABLE Ia
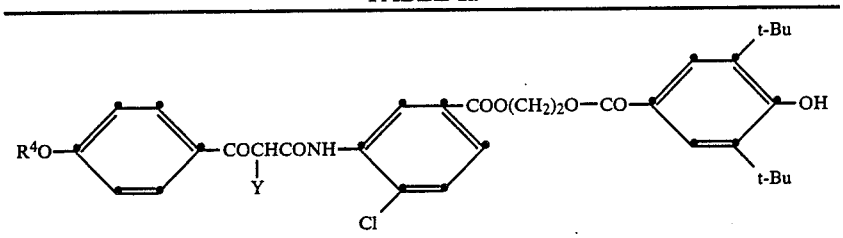
| Coupler | $R^4$ | Y |
|---|---|---|
| C1 | n-$C_4H_9$ | 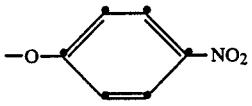 |
| C2 | n-$C_4H_9$ | 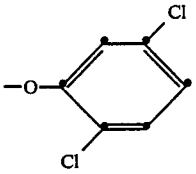 |
| C3 | n-$C_4H_9$ | 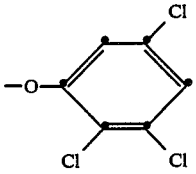 |
| C4 | $CH_3$ | 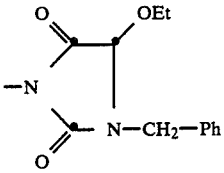 |
Conventionally ballasted couplers representing the prior art are listed below in Tables II and IIa. (t-Bu herein means t-butyl.)
TABLE II
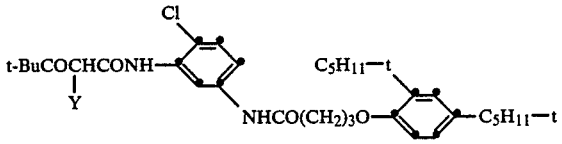
| Coupler | | Y |
|---|---|---|
| B1 | (Comparative Coupler) | 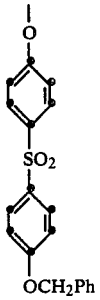 |
TABLE II-continued
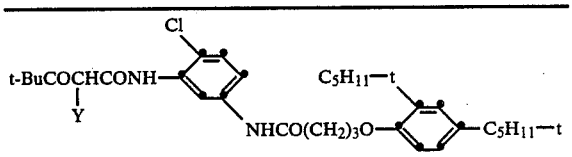
| Coupler | | Y |
|---|---|---|
| B2 | (Comparative Coupler) | 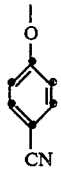 |
| B3 | (Comparative Coupler) | 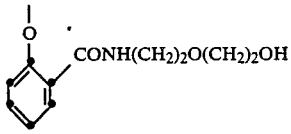 |

TABLE II-continued

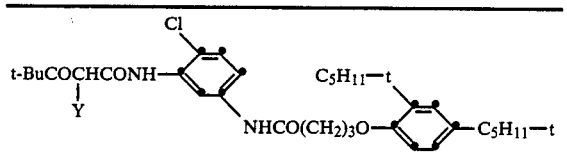

| Coupler | | Y |
|---|---|---|
| B4 | (Comparative Coupler) | 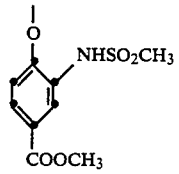 |

TABLE IIa

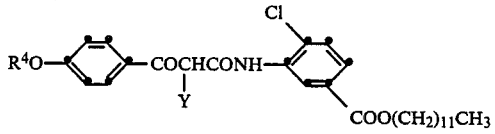

| Coupler | $R^4$ | Y |
|---|---|---|
| D1 | n-$C_4H_9$ | 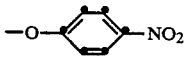 |

The following Examples are included for a better understanding of the invention. The words ALKANOL XC, SURFACTANT 10G, WRATTEN, and EASTMAN are trade names or trademarks.

EXAMPLE 1

A dispersion of each coupler was prepared so as to yield 0.9 $m^2$ of coating with the following lay-downs in $mg/m^2$.

Coupler: 1.244×mol wt coupler
Coupler solvent: 0.25×1.244×mol wt coupler
Gelatin: 1614
Silver: 365.8.

The dispersions were prepared as follows. In a 100 ml beaker (A) is placed the coupler (2.311 mmole), the coupler solvent [(0.577×mol wt coupler)mg] and the auxiliary solvent [(3×wt of coupler used)ml]. In a second beaker (B) is placed 20.0 ml of 12.5% bone gelatin, 3 ml ALKANOL XC (10% solution) and a calculated amount of water to give a total volume (contents of (A) and (B)) of 41.6 ml (this is the calculated amount of water to give 6% gel for milling). This mixture is then kept at 40°-50° C. until used (Solution B). The contents of beaker (A) are heated gently until dissolution of coupler is complete to give Solution (A). Solution (B) is poured directly into Solution A with stirring and immediately milled twice through a colloid mill (0.1 mm setting). The mill is air blown to remove as much as possible of any residual dispersion left inside. The milled dispersion is then placed into a water bath (40°-50° C.) to defoam (about 30 min). Half (20.8 ml) of the total calculated volume of milled dispersion is used as follows.

In a coating jar the following is placed:
20.8 ml milled dispersion
1.0 ml SURFACTANT 10G (spreading agent 10% aqueous soln.)
Emulsion
Distilled water to 60 ml.

The above is coated at 65 $ml.m^{-2}$ to yield 0.9 $m^2$ of coating. Finally, an overcoat layer containing 1076 $mg.m^{-2}$ gel and an incorporated hardener is coated on top of the dispersion layer.

EVALUATION OF COATINGS

Test coupler coatings prepared as described in Example 1, were exposed using an EASTMAN Intensity sensitometer automatic type 1B, Model IV as follows:
Light temperature: 3000° K.
Exposure time: 0.1 second
Step tablet: Type M carbon, 0-3
Density: 0.15 increment; 21 steps
Filters used with exposure: WR-98, I.R., The coating strips were processed using as color developer a compound of the formula:

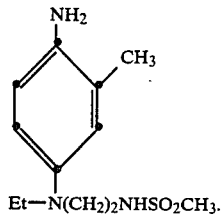

D log E curves were generated by an EASTMAN reflection densitometer with 0°-45° geometry (negative sense), 21 steps with increments of 0.15 for status A integral densities of red, green and blue.

The coating strips were then exposed to a high intensity Xenon light source at a luminous flux level of 50 flux with a WRATTEN 2B filter interposed between the light source and sample. After a suitable time, the strips were removed and the decrease in density from an initial density of 1.7, was determined as a measure of the fade of each sample dye.

The results are shown in Table III below.

TABLE III

| Coupler | ΔD (from D = 1.7) 2 weeks |
|---|---|
| A1 | −0.06 |
| A2 | −0.06 |
| A3 | −0.09 |
| B1 (Comparison) | −0.14 |
| B2 (Comparison) | −0.08 |
| B3 (Comparison) | −0.11 |

EXAMPLE 2

A further set of test coatings was prepared and exposed as described in Example 1. The strips were then processed using a color developing agent of the formula:

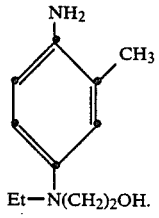

D log E curves were generated from the processed strips and subsequently exposed to high intensity light as in Example 1 with a UV 994H filter interposed between the light source and the sample. After 2 weeks the strips were removed and the decrease of density from an initial density of 1.0 was determined. The results are shown in Table IV below.

TABLE IV

| Coupler | ΔD (from D = 1.0) 2 weeks |
|---|---|
| A5 | −0.05 |
| A6 | −0.10 |
| A7 | −0.08 |
| A8 | −0.14 |
| A9 | −0.12 |
| A10 | −0.12 |
| A11 | −0.06 |
| A12 | −0.12 |
| B1 (Comparison) | −0.17 |
| B2 (Comparison) | −0.20 |
| B3 (Comparison) | −0.23 |
| B4 (Comparison) | −0.27 |

EXAMPLE 3

Preparation of coupler A13 of Table I

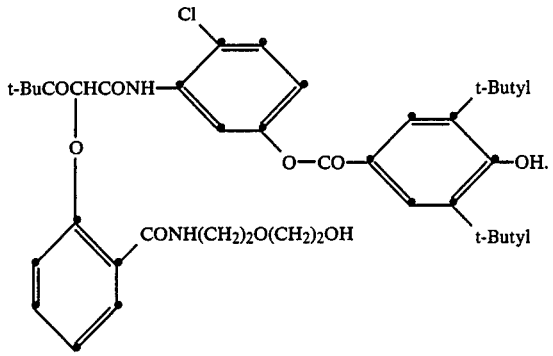

The general preparative scheme illustrated above was followed.

(a) 4-Chloro-3-nitrophenyl 3,5-di-t-butyl-4-hydroxybenzoate 3,5-Di-t-butyl-4-hydroxybenzoyl chloride (56.2 g; 0.209 mole) in tetrahydrofuran (70 ml) was added with stirring to a solution of 4-chloro-3-nitrophenol (36.3 g; 0.209 mole) in pyridine (170 ml) at 0° C. over 20 minutes. The reaction mixture was stirred at room temperature for 22 hours and poured into an ice cold solution of 10M-hydrochloric acid (350 ml) and water (1400 ml). The mixture was extracted into ether (500 ml) and the ethereal extract washed successively with 2M-hydrochloric acid (150 ml), 2% sodium carbonate solution (4×150 ml) and water (2×100 ml). The extract was dried and the ether removed to give a dark orange oil (90 g). This material was chromatographed (silica) eluting with 4:1 hexane:ethyl acetate, to give the product (60.6 g; 72%) as a yellow viscous oil.

Found: C, 62.6; H, 6.2; Cl, 8.0; N, 3.0 $C_{21}H_{24}ClNO_5$ requires: C, 62.1; H, 5.9; Cl, 8.8; N, 3.5%.

(b) 3-Amino-4-chlorophenyl 3,5-di-t-butyl-4-hydroxybenzoate

Iron metal powder (50.2 g; 0.897 mole) and 10M-hydrochloric acid (92 ml; 0.92 mole) were added alternatively over 1½ hr. to a mixture, of the nitro compound (60.6 g; 0.149 mole) from (a), tetrahydrofuran (520 ml) and water (52 ml), heated under reflux. Heating was continued for a further 3½ hr. after which the mixture was filtered. The filtrate was evaporated to dryness and the residue partitioned between toluene (500 ml) and water (400 ml). The layers were separated and the toluene solution filtered through kieselguhr, dried and evaporated to give a solid. This material was crystallized from methanol (100 ml) to give the product (41 g; 75%) as a white solid, m.p. 64°-66° C.

Found: C, 67.0; H, 7.0; Cl, 9.2; N, 3.6. $C_{21}H_{26}ClNO_3$ requires: C, 67.1; H, 6.9; Cl, 9.5; N, 3.7%.

(c) 4-Chloro-3-(4,4-dimethyl-3-oxopentanamido)phenyl 3,5-di-t-butyl-4-hydroxybenzoate A mixture of the amino compound (42.5 g; 0.113 mole) from (b), methyl pivaloyl acetate (21.1 g) and heptane (240 ml), were heated under reflux for 20 hr. during which time methanol was continuously removed. The mixture was cooled, hexane (100 ml) was added and the solid collected and dried to give the product (55.9 g; 90%), m.p. 145°-147° C.

Found: C, 68.3; H, 7.9; Cl, 6.3; N, 2.5. $C_{28}H_{36}ClNO_5 \cdot \frac{1}{2}C_7H_{16}$ requires: C, 68.5; H, 8.0; Cl, 6.4; N, 2.5%.

(d) 4-Chloro-3-(2-chloro-4,4-dimethyl-3-oxopentanamido)phenyl 3,5-di-t-butyl-4-hydroxybenzoate N-chlorosuccinimide (16.3 g; 0.122 mole) was added with stirring to a solution of the compound (55.7 g; 0.1 mole) from (c) in chloroform (480 ml) and stirring continued for 18 hr. The volume of the mixture was reduced to approximately 100 ml and hexane (250 ml) added. The mixture was washed with water (2×100 ml) and the organic solution dried and evaporated to give a solid. This material was crystallized from dichloromethane (100 ml) and hexane (500 ml), to give the product (44.5 g; 83%) as a white solid, m.p. 185°-187° C.

Found: C, 63.0; H, 6.6; Cl, 12.8; N, 2.6. $C_{28}H_{35}Cl_2NO_5$ requires: C, 62.7; H, 6.5; Cl, 13.3; N, 2.6%.

(e) Coupler A13

Triethylamine (4.0 g; 39.3 mmole) was added with stirring to a mixture of the compound (7.0 g; 13.1 mmole) from (d), N-2-(hydroxyethoxy)ethylsalicylamide (3.5 g; 15.7 mmole) and N,N-dimethylformamide (50 ml) at 45° C. Heating and stirring were continued for a further 3 hr. The mixture was cooled and poured into an ice cold solution of 10M-hydrochloric acid (160 ml) and water (400 ml). The solid was collected, dissolved, in ethyl acetate (150 ml) and washed successively with 2M-hydrochloric acid (75 ml) and water (75 ml). Removal of the solvent gave an oil which was chromatographed (silica) eluting with 4:1 ethyl acetate:hexane to give the product (4.5 g; 47%) as a solid foam.

Found: C, 64.1; H, 6.8; Cl, 4.7; N, 3.7. $C_{39}H_{49}ClN_2O_9$ requires: C, 64.6; H, 6.8; Cl, 4.9; N, 3.9%. The following couplers of this invention were prepared in a similar manner to coupler A13 from the appropriate starting materials. Table V summarizes their melting points and elemental analyses.

TABLE V

| | | Found | | | | Requires | | | |
|---|---|---|---|---|---|---|---|---|---|
| Cp* | m.p.°C. | C | H | Cl | N | C | H | Cl | N |
| A1 | foam | 65.9 | 6.3 | 5.2 | 3.8 | 66.0 | 6.2 | 5.1 | 4.1 |
| A2 | foam | 63.7 | 6.7 | 4.8 | 3.7 | 64.4 | 6.4 | 5.0 | 4.0 |
| A3 | 137-139 | 61.8 | 6.1 | 9.3 | 1.8 | 61.7 | 5.9 | 9.4 | 1.8 |
| A4 | 153-154 | 68.3 | 6.6 | 5.4 | 4.2 | 68.3 | 6.5 | 5.6 | 4.4 |
| A5 | 143-145 | 68.0 | 6.4 | 5.9 | 4.4 | 67.9 | 6.3 | 5.7 | 4.5 |
| A6 | 112-115 | 65.8 | 6.8 | 4.9 | 5.5 | 65.8 | 6.7 | 4.7 | 5.6 |

TABLE V-continued

| Cp* | m.p.°C. | Found C | Found H | Found Cl | Found N | Requires C | Requires H | Requires Cl | Requires N |
|---|---|---|---|---|---|---|---|---|---|
| A7 | foam | 65.8 | 7.1 | 5.2 | 3.8 | 65.7 | 6.8 | 5.1 | 4.0 |
| A8 | 165–168 | 67.7 | 6.1 | 4.2 | 1.5 | 67.5 | 6.1 | 4.2 | 1.7 |
| A9 | 181–183 | 64.3 | 6.0 | 10.7 | 4.1 | 64.3 | 5.8 | 10.9 | 4.3 |
| A10 | foam | 62.2 | 6.3 | 9.3 | 5.2 | 62.5 | 6.1 | 9.2 | 5.5 |
| A11 | foam | 61.9 | 6.6 | 9.1 | 3.5 | 61.7 | 6.3 | 9.4 | 3.7 |
| A12 | foam | 64.8 | 6.7 | 4.4 | 5.4 | 65.4 | 6.5 | 4.8 | 5.7 |
| A13 | foam | 64.1 | 6.8 | 4.7 | 3.7 | 64.6 | 6.8 | 4.9 | 3.9 |
| A14 | 218–221 | 68.4 | 6.6 | 5.7 | 6.8 | 68.0 | 6.5 | 5.7 | 6.8 |
| A15 | 149–151 | 64.7 | 7.1 | 4.9 | 5.7 | 64.7 | 6.9 | 4.9 | 5.8 |
| A16 | 135–136 | 65.3 | 7.0 | 4.8 | 7.3 | 65.5 | 6.7 | 4.8 | 7.6 |

*Cp stand for coupler.

EXAMPLE 4

Preparation of Experimental Photographic Coatings

Coupler C1 of Table Ia was dissolved in half its weight of di-n-butylphthalate, with one and a half times its weight of cyclohexanone as auxiliary solvent and dispersed in gelatin as in Example 1. The auxiliary solvent was removed from the dispersion by continuous washing for 6 hours at 4° C. and pH 6.0.

Experimental photographic coatings were prepared by coating a cellulose acetate film support with a photosensitive layer comprising a dispersion of the novel coupler as formulated above coated at a laydown of 1.93 mmol/m$^2$, a silver bromoiodide emulsion at 0.81 g Ag/m$^2$ and gelatin at 2.42 g/m$^2$. An overcoat containing gelatin at 0.89 g/m$^2$ was applied to the photosensitive layer. Bis-vinyl sulphonylmethane at 1.75% by weight of the total gelatin in the pack was also incorporated into the photosensitive layer. The experimental coatings were then slit and chopped into 35 mm×12 inch test strips.

Spectrophotometric testing 35 mm test strips were exposed through a 0–0.3 ND stepwedge (0.1 incremental steps) test object and Daylight V, Wratten 35 and 38A filters and the correct ND filters to give an optical density of ca. 1.0. The strips were processed through a deep-tank sink line at 37.8° C. using the following standard process:

Colour Developer: 2.5 minutes
Bleach (FeIII/EDTA): 4.0 minutes
Wash: 2.0 minutes
Fix: 4.0 minutes
Wash: 2.0 minutes.

The processed strips were then dried to give stepped yellow dye images. C-41 processing chemicals were used with 4-amino-3-methyl-N-ethyl-N-2-hydroxyethyl-aniline sulphate as the active component of the colour developer solution. Samples for fading were cut from the yellow dye image step with density closest to 1.0. Visible absorption spectra (normalized to 1.0 density) were obtained using a Pye Unicam SP-100 Spectrometer. The dye sample patches were tested for light stability using the EDIE fadeometer for a fade time of 200 hours. The spectrophotometric curves are remeasured after the fade period and the degree of fade quoted as the fractional decrease in density at the absorption maximum (ΔD) relative to the initial density (1.0) prior to fading.

The method used in the EDIE fadeometer is as follows: the dye samples (protected by a Wratten 2B filter) are carried on a fixed plate on both sides of which are set a pair of 'Osram' Colour Matching Fluorescent tubes (75–85 Watt, a total luminous flux level of 18.8 flux), 2 cm apart and 4 cm from the plate in a humidity controlled room at 20° C., 50% RH. The fluorescent tubes emit mainly in the range 400–700 nm.

The results are given below in Table VI together with the results for a comparative coupler of the prior art (Coupler D1 of Table IIa).

TABLE VI

| Coupler | ΔD (from D = 1.0) 200 h EDIE |
|---|---|
| C1 | −0.23 |
| D1 | −0.43 |

EXAMPLE 5

Preparation coupler C1 of Table Ia

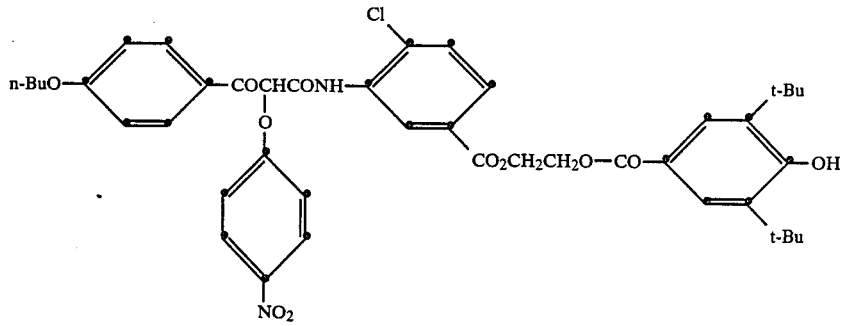

(a) 2-Hydroxyethyl 4-chloro-3-nitrobenzoate

4-Chloro-3-nitrobenzoyl chloride (22.0 g, 0.1 mole) in ethanediol (90 ml) was heated on a steam bath for 10 minutes. A clean solution was formed. The solution was stirred at room temperature for 30 minutes and then water (220 ml) was added. After stirring for a further 2 hours, the precipitate was collected by filtration and washed well with water to give the product (16 g, 65%) as a white solid m.p. 96°–97° C.

Found C, 44.0; H, 3.4; Cl, 14.2; N, 5.6. $C_9H_8ClNO_5$ requires: C, 44.0; H, 3.3; Cl, 14.5; N, 5.7%.

(b) 2-(4-Chloro-3-nitrophenylcarboxy)ethyl 3,5-di-t-butyl-4-hydroxybenzoate

A solution of the benzoate (13.7 g, 55.9 mmole) from (a) and 3,5-di-t-butyl-4-hydroxybenzoyl chloride (15.0 g, 55.9 mmole) in dichloromethane (50 ml) were heated under reflux for 42 hours. The solvent was removed by rotary evaporation, and the residue crystallized from 10% toluene in hexane, to give the product (22.9 g, 86%) as a white solid. m.p. 106°–108° C.

Found: C, 60.1; H, 5.9; Cl, 7.0; N, 2.9. $C_{24}H_{28}ClNO_7$ requires: C, 60.3; H, 5.9; Cl, 7.4; N, 2.9%.

(c) 2-(3-Amino-4-chlorophenylcarboxy)ethyl 3,5-di-t-butyl-4-hydroxybenzoate

Iron metal powder (13.4 g, 0.24 mole) was added portionwise to a solution of the nitro compound (22.9 g, 0.048 mole) from (b) in acetic acid (110 ml) and water (10 ml), heated on a steam bath. Heating was continued for a further 3 hours, after which the suspension was filtered hot through kieselguhr. The filtrate was poured into a mixture of ice/water (1 liter) with rapid stirring and the precipitate was collected by filtration to give the product as a white solid (20 g, 93%). m.p. 122°-124° C.

Found: C, 63.9; H, 6.8; Cl, 7.7; N, 3.2. $C_{24}H_{30}ClNO_5$ requires: C, 64.4; H, 6.7; Cl, 7.9; N, 3.1%.

(d) 4-n-Butoxyacetophenone

A suspension of 4-hydroxyacetophenone (27.2 g, 0.2 mole), 1-bromobutane (41.8 g, 0.305 mole) and potassium carbonate (41.4 g, 0.3 mole) in acetone (400 ml) were heated under reflux for 48 hours. Water (200 ml) was then added and the mixture extracted with ethyl acetate (300 ml) and washed with water (2×150 ml). The organic solution was dried and evaporated under reduced pressure to give an orange liquid which solidified on cooling to give the product (38.0 g, 99%) which was used in the next reaction without further purification.

(e) Ethyl 3-(4-butoxyphenyl)-3-oxopropanoate

The acetophenone (9.6 g, 0.05 mole) from (d) was added to a suspension of potassium t-butoxide (9.0 g, 0.08 mole) in diethyl carbonate (24.0 g, 0.2 mole) at 75° C. over 10 minutes. Toluene (40 ml) was added to keep the suspension mobile and heating at 95° C. continued for 30 minutes. After cooling to 50° C., the suspension was poured into cold water (500 ml) and extracted with ethyl acetate (300 ml). The organic solution was dried and evaporated under reduced pressure to give the product (13.2 g, 95%) as a dark red liquid which was used in the next reaction without further purification.

(f) 2-{3-[3-(4-n-Butoxyphenyl)-3-oxopropanamido]-4-chlorophenylcarboxy}ethyl 3,5-di-t-butyl-4-hydroxybenzoate A solution of the aniline from (c) (19.8 g, 44.2 mmole) and the β-ketoester from (e) (13.0 g, 44.2 mmole) in xylene (160 ml) were heated under reflux, using a Dean & Stark apparatus, for 5 hours. Over the final hour, the volume of the mixture was reduced to 75 ml by distillation. 60–80 petroleum ether (300 ml) was added with cooling and the solid collected by filtration. The product was isolated as a brown solid (24.2 g, 82%). m.p. 94–96%.

Found: C, 66.2; H, 6.6; Cl, 5.5; N, 2.0. $C_{24}H_{44}ClNO_8$ requires: C, 66.7; H, 6.6; Cl, 5.3; N, 2.1%.

(g) 2-{3-[3-(4-n-Butoxyphenyl)-2-chloro-3-oxopropanamido]-4-chlorophenylcarboxy}ethyl-3,5-di-t-butyl-4-hydroxybenzoate Sulphuryl chloride (4.9 g, 36.2 mmole) in dichloromethane (10 ml) was slowly added to a solution of the 4 equivalent coupler from (f) (24.1 g, 36.2 mmole) in dichloromethane (140 ml). After stirring at room temperature for 21 hours, the volatiles were removed by rotary evaporation. The product was isolated as a yellow oil (25.1 g, 99%) and was used in the next reaction without further purification.

(h) 2-{3-[3-(4-n-butoxyphenyl)-2-(4-nitrophenoxy)-3-oxopropanamido]-4-chlorophenylcarboxy}ethyl-3,5-di-t-butyl-4-hydroxybenzoate. Coupler C1.

Triethylamine (10.9 g, 108 mmole) was added to a solution of the chloro-coupler (25.1 g, 35.9 mmole) from (g) and 4-nitrophenol (10.0 g, 71.7 mmole) in dry DMF (110 ml) at 45°-50° C. under nitrogen with nitrogen. After stirring at 45°-50° C. under nitrogen for 2.5 hours, the suspension was cooled and poured slowly into cold water (1000 ml) and conc. hydrochloric acid (10 ml), with rapid stirring. The whole mixture was extracted with ethyl acetate (400 ml) and the organic solution washed with 3N sodium carbonate (2×150 ml), 3M hydrochloric acid (100 ml), dried and evaporated under reduced pressure. The crude material was recrystallized twice from ethanol to give the product as a pale yellow solid (12.5 g, 43%). m.p. 102°-104° C.

Found: C, 63.5; H, 5.9; Cl, 4.8; N, 3.4. $C_{43}H_{47}ClN_2O_{11}$ requires: C, 64.3; H, 5.9; Cl, 4.4; N, 3.5%.

The invention has been described in detail with particular reference to preferred embodiments thereof, but it will be understood that variations and modifications can be effected within the spirit and scope of the invention

What is claimed is:

1. A color photographic element comprising a support bearing at least one photographic silver halide emulsion layer and a yellow dye-forming acetanilide coupler having a group comprising a stabilizer moiety represented by the formula:

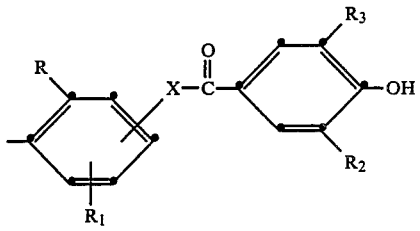

wherein

R is halogen or alkoxy having 1 to 4 carbon atoms;

$R_1$ is hydrogen, halogen, alkyl or alkoxy;

$R_2$ and $R_3$ are individually alkyl; and

X is a linking group.

2. A photographic element as in claim 1 wherein the group comprising the stabilizer moiety is a ballast group that enables the coupler to be non-diffusible in the photographic element.

3. A photographic element as in claim 1 wherein the coupler is represented by the formula:

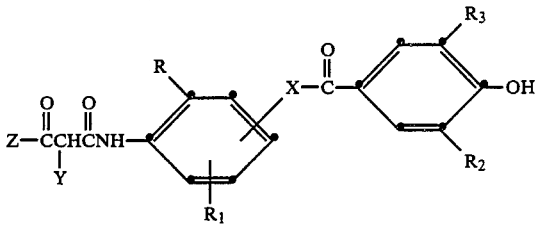

wherein

R is halogen or alkoxy having 1 to 4 carbon atoms;

$R_1$ is hydrogen, halogen, alkyl or alkoxy;

$R_2$ and $R_3$ are individually alkyl;

X is a linking group;

Y is hydrogen or a coupling-off group; and

Z is t-butyl or p-alkoxyphenyl.

4. A photographic element as in claim 1 wherein R is chloro or methoxy.

5. A photographic element as in claim 1 wherein $R_1$ is hydrogen, chloro, methyl or methoxy.
6. A photographic element as in claim 1 wherein X is alkylene, —O—, —alkylene—O—, —COO—alkylene—O—, —O—alkylene—O—, or —NH—.
7. A photographic element as in claim 1 wherein the group comprising the stabilizer moiety is:
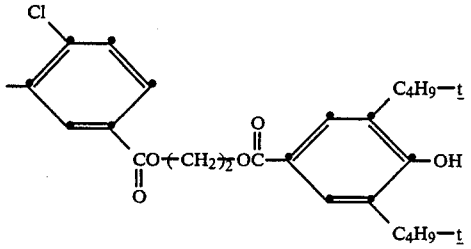
-continued
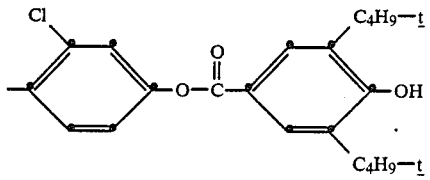
or
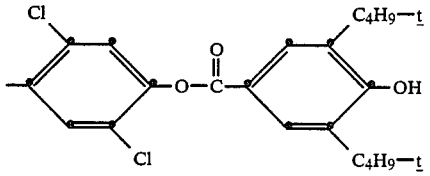
8. A photographic element as in claim 1 wherein the coupler is:
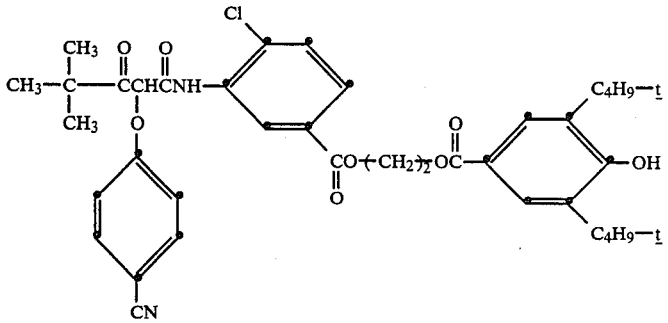
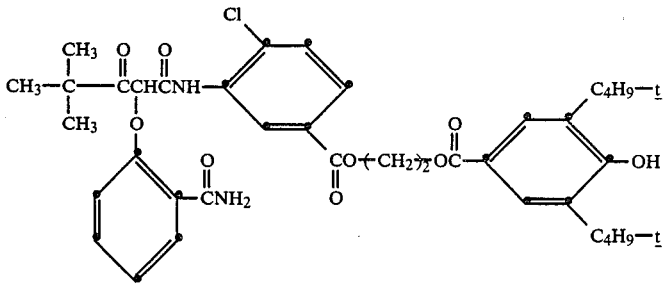
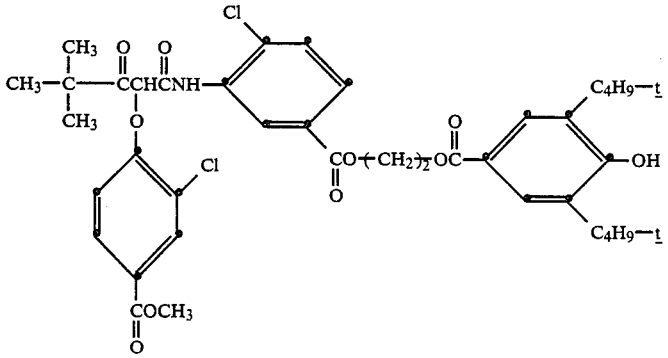

-continued

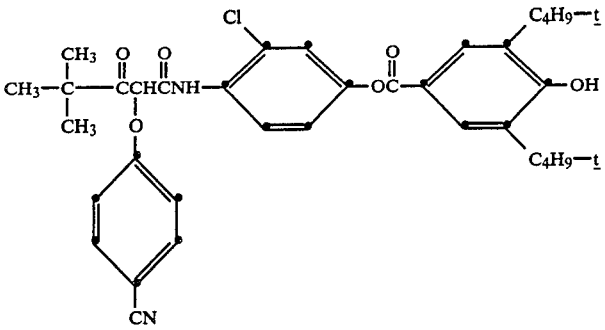

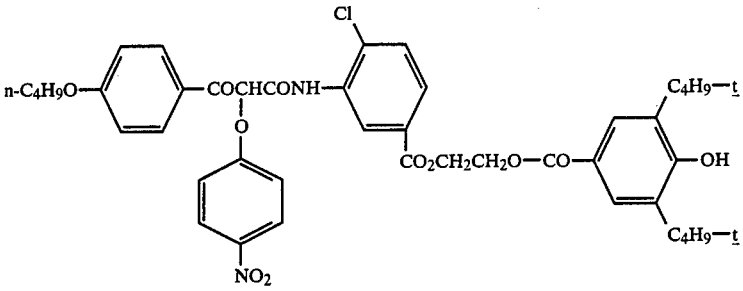

or

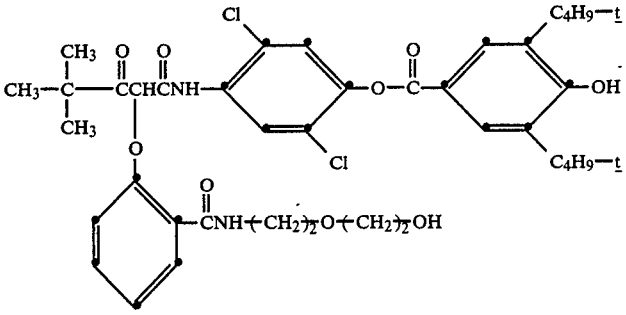

9. A color photographic element as in claim 1 comprising a red-sensitive silver halide emulsion unit having associated therewith at least one cyan dye-forming coupler; a green-sensitive silver halide emulsion unit having associated therewith at least one magenta dye-forming coupler; and, at least one blue-sensitive silver halide emulsion unit having associated therewith at least one yellow dye-forming coupler; and, wherein said acetanilide coupler is associated with at least one of said units.

10. A process of forming a photographic image which comprises developing an exposed silver halide emulsion layer with a color developing agent in the presence of a yellow dye-forming acetanilide coupler as defined in claim 1.

11. A process as in claim 10 wherein the pivaloylacetanilide coupler is:

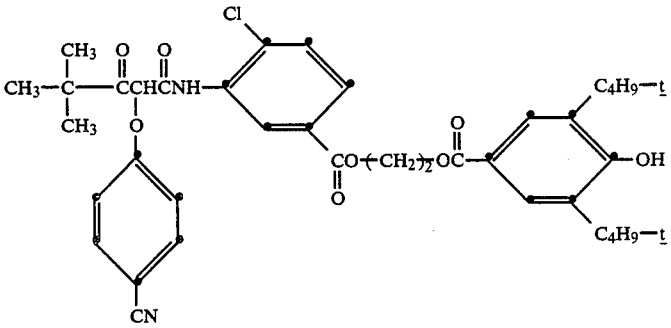

-continued
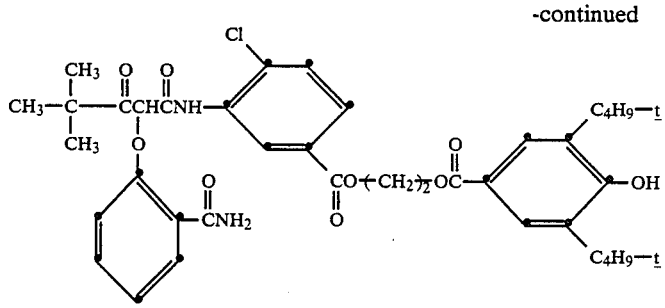
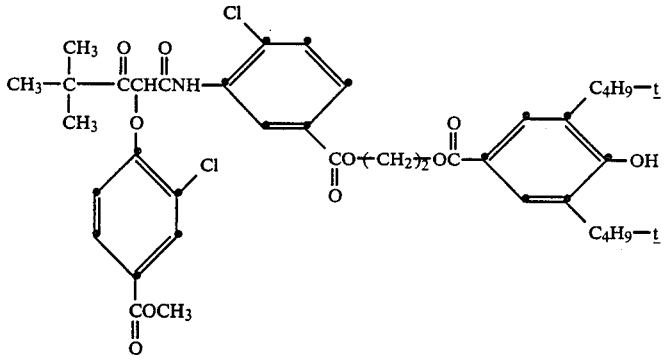
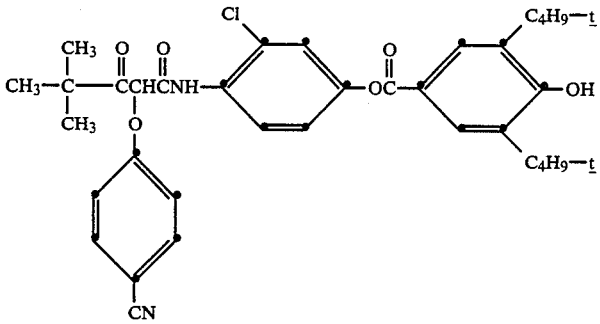
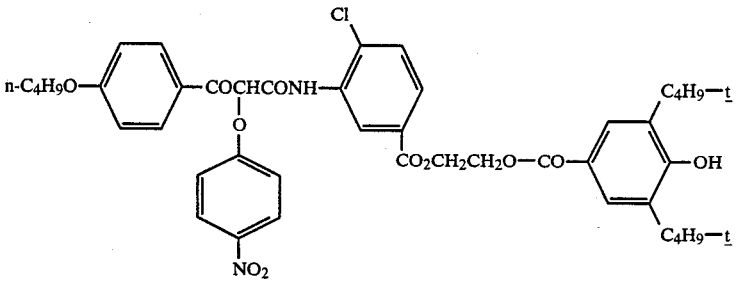
or
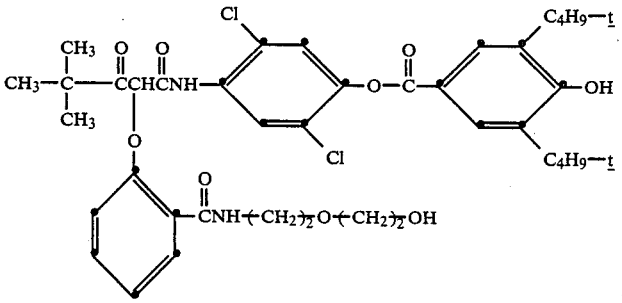
* * * * *